United States Patent [19]

Andersson

[11] 4,212,113

[45] Jul. 15, 1980

[54] APPARATUS FOR DRYING AN AIR-BORNE WEB

[75] Inventor: Karl-Hugo S. Andersson, Vaxjo, Sweden

[73] Assignee: AB Svenska Flaktabriken, Stockholm, Sweden

[21] Appl. No.: 934,401

[22] Filed: Aug. 17, 1978

[30] Foreign Application Priority Data

Aug. 18, 1977 [SE] Sweden ..... 7709332

[51] Int. Cl.[2] ..... F26B 13/20

[52] U.S. Cl. ..... 34/156; 34/85; 226/97

[58] Field of Search ..... 34/155, 156, 160, 85; 226/97

[56] References Cited

U.S. PATENT DOCUMENTS

| | | | |
|---|---|---|---|
| 3,371,427 | 3/1968 | Thygeson, Sr. | 34/155 |
| 3,429,057 | 2/1969 | Thygeson, Sr. | 34/160 |

FOREIGN PATENT DOCUMENTS

| | | | |
|---|---|---|---|
| 1460610 | 6/1970 | Fed. Rep. of Germany | 34/155 |
| 665238 | 1/1952 | United Kingdom | 34/160 |
| 259699 | 5/1970 | U.S.S.R. | 34/155 |

*Primary Examiner*—Edward G. Favors
*Assistant Examiner*—Harold Joyce
*Attorney, Agent, or Firm*—Dann, Dorfman, Herrell and Skillman

[57] ABSTRACT

Web-drying apparatus having a plane of lower blow boxes underlying the path of travel of the web to blow dry air against the undersurface of the web to support the same in closely-spaced relation to the blow box. Upper blow boxes are disposed on the upper side of the web closely adjacent the plane of travel of the web. The upper blow boxes are disposed in pairs extending diagonally across the full width of the web and terminating at opposite ends in fan chambers which are located in spaced locations along the sides of the path of travel of the web. The blow boxes in each pair diverge from the fan chamber, one extending forwardly and one extending rearwardly in the direction of the web travel to provide an angular space therebetween which provides free access to the web path and also to enable exhaust spent drying medium therethrough. The opposite ends of the blow boxes are closed in alternation.

1 Claim, 1 Drawing Figure

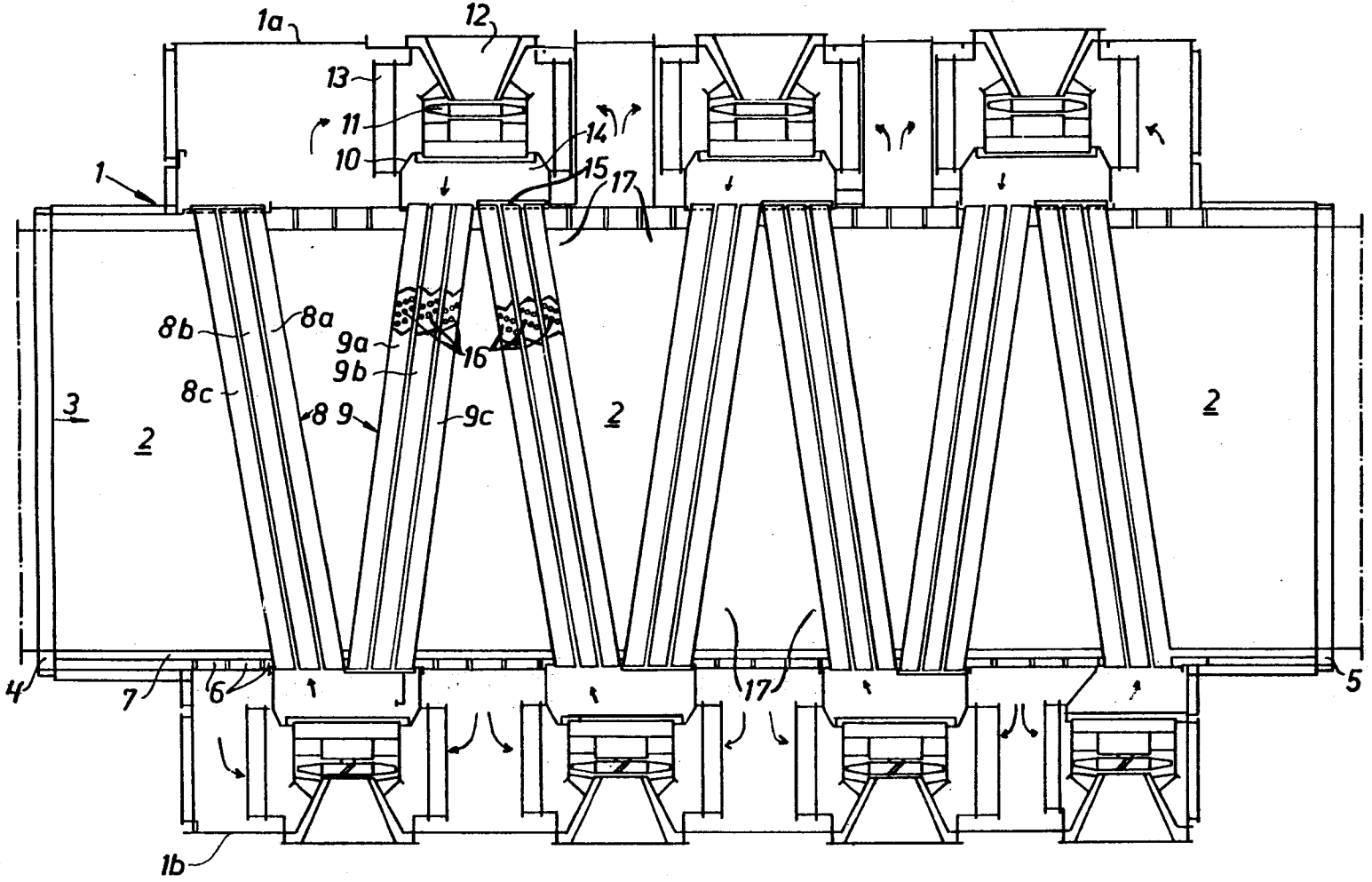
1
1a
1b
2
3
4
5
6
7
8
8a
8b
8c
9
9a
9b
9c
10
11
12
13
14
15
16
17

APPARATUS FOR DRYING AN AIR-BORNE WEB

The present invention relates to apparatus for drying web material which is supported on drying air blown from an underlying series of blow boxes arranged in a plane, and in which additional drying air is supplied to the upper surface of the traveling web to increase the drying effect. In particular, the present invention relates to a novel arrangement of blow boxes overlying the web which insures access to the web plane for cleaning in the event of web rupture as well as space for exhausting air from the web.

In the paper and cellulose industry, it has been necessary to reduce the capital investment for production, and this demand has been especially apparent in drying plants of this industry. In order to increase the efficiency of drying, the material to be dried is impinged with drying medium on both the upper and lower surfaces by blow boxes which are located as close as possible to the path of travel of the material, thereby reducing the volume of the drying apparatus. In such plants, the close position of the blow boxes to the web path enables the material to be advanced air-borne in a fixed stable floating position above the lower plane of blowing boxes. However, with such a compact arrangement, it is difficult to satisfactorily clean up web fragments after a web rupture occurs and also it is difficult to provide the necessary space for exhausting the spent drying medium.

The present invention provides an improved structural arrangement which solves the aforesaid problem.

In accordance with the invention, the blow boxes overlying the web path are arranged in pairs connected to fan chambers disposed at spaced locations along at least one side of the drying plant, the blow boxes extending across the entire width of the web path at an acute angle, one box of each pair extending obliquely forwardly of the web travel and the other extending obliquely rearwardly of the web travel to provide a V-shaped or divergent orientation. The divergent orientation opens to the opposite side of the web path so that it may provide an easily accessible suction compartment for exhausting spent drying medium and also for permitting access to the web path through this suction compartment. The spent drying air from the angularly oriented blow boxes may spill into these suction compartments unobstructed. A preferred embodiment of the invention has fan chambers disposed at spaced locations along both sides of the web path with the fan chambers disposed at the peak of the V-shaped compartment opposite the suction compartment formed between the blow boxes. The suction of the fan chambers is operable to withdraw spent drying air from the suction compartment alongside the fan chamber. In this way, in the event suction is lost in the one suction compartment, the operation of the dryer may continue with suction being supplied from the pair of V-shaped compartments on opposite sides of the disabled suction compartment. The blow boxes extend between fan chambers at opposite sides of the web path but each blow box is closed at one end so that it is only fed from one fan chamber.

The invention is described in greater detail hereinafter with reference to the accompanying drawing which shows an example which may readily be modified within the scope of the present invention:

The FIGURE is a horizontal section through a drying apparatus made in accordance with the present invention taken at a level above the upper blow boxes.

In the drawing, the drying apparatus 1 has longitudinal side portions 1*a* and 1*b*. The material 2 to be dried, preferably a web, flows through the apparatus in the direction indicated by the arrow 3 from the inlet 4 to the outlet 5. In its travel through the apparatus, the material is supported on drying air blown upwardly against the undersurface of the web 2 from a series of blow boxes 6 disposed in a plane underlying the web path and which preferably are constructed according to Swedish Pat. No. 320,321. and the corresponding U.S. Pat. No. 3,231,165, both of which are incorporated herein by reference. As disclosed, the supporting air causes the web to float at a constant position above the plane of the blow boxes 6 whereby good drying economy is obtained. A suitable threading device 7 extends through the web plane for threading or re-threading the web during startup or in the event of web rupture.

In accordance with the present invention, blow boxes 8 and 9 are provided above the path of travel of the web in pairs connected to fan chambers 10 disposed at spaced locations along the length of the web path on opposite sides thereof. Each fan chamber 10 has a fan 11, in this case a propeller fan, and has a fan inlet 12 and a fan outlet 14. A steam battery or heat exchanger 13 is provided around the inlet 12. In the illustrated embodiment, each of the blow boxes in the pairs 8 and 9 consists of a group of three upper blow boxes desiganted 8*a*, 8*b* and 8*c*; and 9*a*, 9*b* and 9*c*, respectively. A cover plate 15 is provided to close each group of blow boxes alternatively at opposite ends at one side or the other of the drying apparatus. As shown, the blow boxes extend from one fan chamber to another and the plate 15 insures that the blow boxes are fed alternatively from the alternate fan chambers, one box of each pair being fed from one side of the web path and the other being fed from the other side. This step has been taken in order to assure as uniform a drying profile as possible. From the upper blow boxes, the drying air is supplied to the material through a great number of circular apertures 16 having a pattern as shown in the drawing. As shown, the blow boxes 8 and 9 diverge from the fan chamber and provide an angular suction chamber 17 having a great area between each pair. The exhaust of air from blow boxes arranged according to the present invention is at a lower speed than conventional, so that the suction generated in the angular suction chambers is not sufficient to disturb the operation of the threading device 7, which is normally located at one side of the drying plant. For example, the threading device may be an endless belt extending along one side of the drying plant. The design of the suction chambers 17 enables access to the path of web travel in the event of web rupture. Thus, the size of the suction compartments contributes to improved operating economy by enabling continued operation with the shortest possible breakdowns of operation.

I claim:

1. Apparatus for drying web material with air comprising a first series of transversely-oriented and uniformly longitudinally spaced-apart supporting blow boxes disposed in a plane underlying the undersurface of the web in its plane of travel through the apparatus to blow drying air against the undersurface of the web to support the web in closely-spaced relation to the plane of said blow boxes, a second series of blow boxes disposed on the upper side of the web in a plane closely adjacent the plane of travel of the web through the apparatus, said upper blow boxes being disposed above the upper surface of the web in pairs, said upper blow boxes being of uniform width in their plane, a fan chamber for each of the upper blow boxes, said fan chambers being disposed at spaced locations along the length of at least one side of the dryer apparatus, said pairs of upper blow boxes extending diagonally from each fan chamber at a divergent angle respectively forwardly and rearwardly of the direction of web travel in said plane, said divergent upper blow boxes defining angularly shaped open spaces therebetween, the wide side of said open spaces spanning at least three of said lower blow boxes and the narrow side of said open spaces spanning less than one of said lower blow boxes, said open spaces serving as suction compartments for the exhausting of spent drying air from the upper surface of the web, said open spaces further providing free access to the web path between said blow boxes to facilitate cleaning of the web path in the event of web rupture.

* * * * *